US005608177A

United States Patent [19]

Zadworny

[11] Patent Number: 5,608,177

[45] Date of Patent: Mar. 4, 1997

[54] MULTIPLE HARMONICA HOLDER

[76] Inventor: Richard Zadworny, 4500 Excelsior Blvd., Ste. 9, St. Louis Park, Minn. 55416-4965

[21] Appl. No.: 361,960

[22] Filed: Dec. 22, 1994

[51] Int. Cl.[6] ..... G10D 7/12

[52] U.S. Cl. ..... 84/379; 224/910

[58] Field of Search ..... 84/379, 453; 224/910

[56] References Cited

U.S. PATENT DOCUMENTS

| | | | |
|---|---|---|---|
| 322,586 | 7/1885 | Dawley | 84/329 |
| D. 332,959 | 2/1993 | Ileo | 84/379 |
| 1,535,206 | 4/1925 | Davidson | 84/329 |
| 1,954,169 | 4/1934 | Futer | 84/329 |
| 4,287,803 | 9/1981 | Zema | 84/379 |
| 4,397,213 | 8/1983 | Hubbard | 84/379 |
| 4,414,879 | 11/1983 | Ruiz | 84/379 |
| 4,713,999 | 12/1987 | Burt | 84/379 |
| 4,739,686 | 4/1988 | Doll | 84/379 |

*Primary Examiner*—Cassandra C. Spyrou
*Attorney, Agent, or Firm*—Merchant, Gould, Smith, Edell, Welter & Schmidt, P.A.

[57] ABSTRACT

A multiple harmonica holder for supporting a plurality of harmonicas from the neck and shoulders of a musician. The multiple harmonica holder includes a harmonica holder device and a support for positioning the harmonicas such that they are accessible for playing at any given time without the use of the musician's hands.

17 Claims, 4 Drawing Sheets

FIG. 6
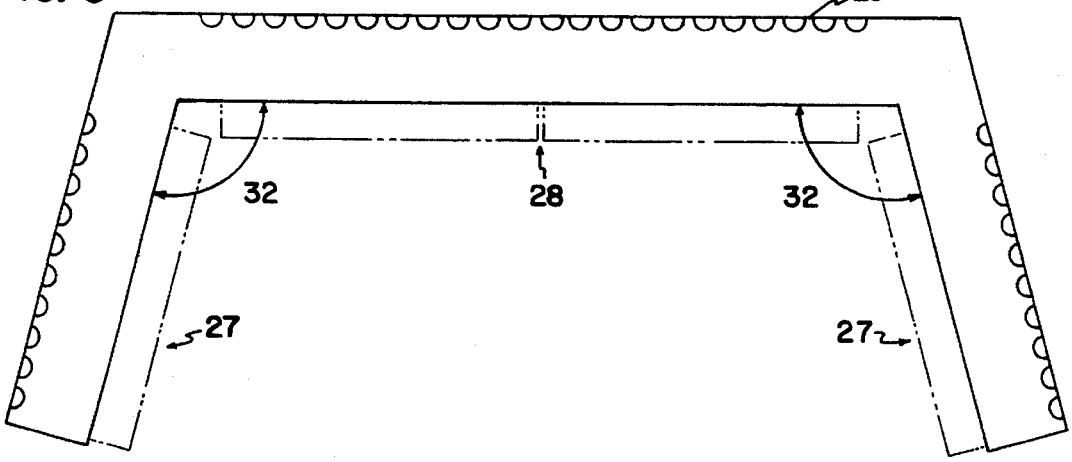
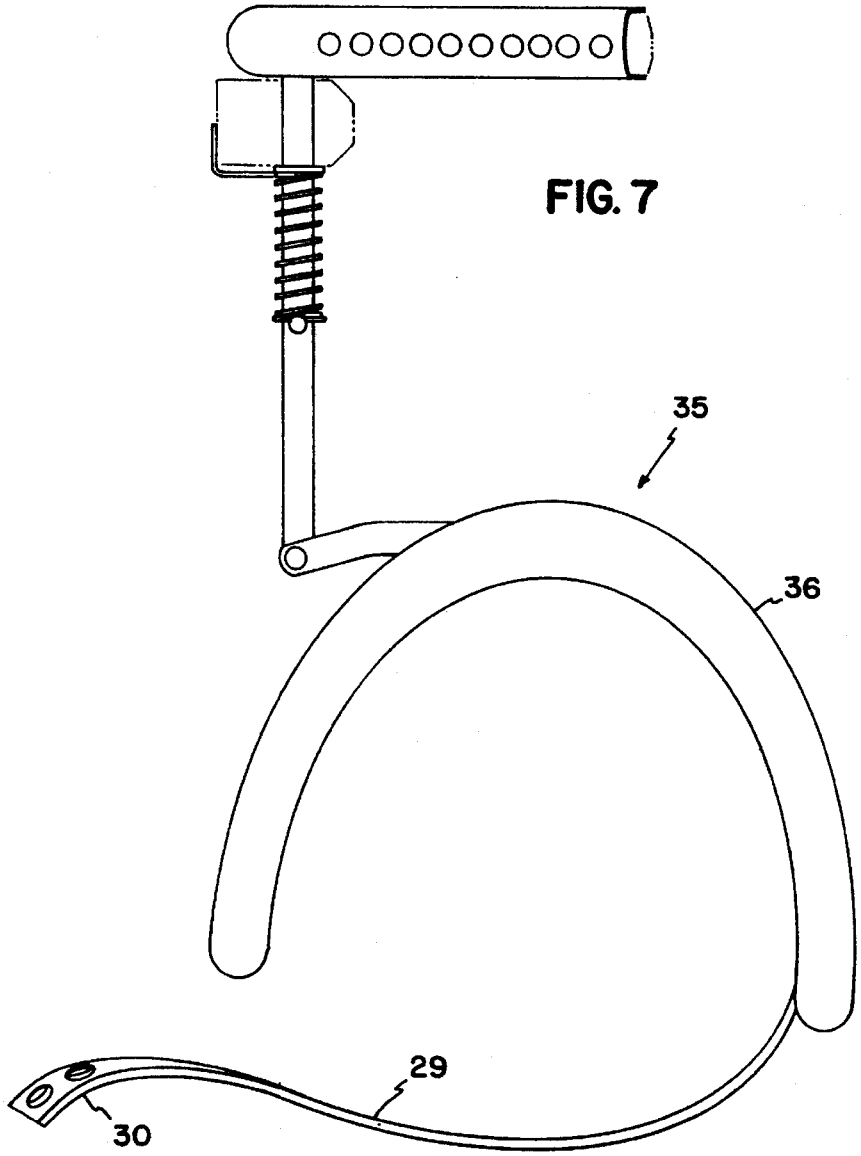
FIG. 7

MULTIPLE HARMONICA HOLDER

BACKGROUND OF THE INVENTION

1. Field of the Invention

The present invention is directed to a harmonica support apparatus, and in particular to a multiple harmonica support apparatus.

2. Description of the Prior Art

Harmonica playing is an art form practiced by many musicians. Over the years, different types of harmonicas have been developed, each producing a unique sound quality. For example, some harmonicas are best suited for jazz music, while others are suited for blues music, and still others are multi-purpose. Often, an individual harmonica player will be proficient in playing numerous types of harmonicas and will wish to play multiple harmonicas in quick succession, even alternating notes between two or more different harmonicas.

Traditionally, harmonicas are played by being held to the player's mouth by their hands. However, it is often desirable for the player to be able to play the harmonica without the use of his or her hands. For example, the harmonica player may wish to play another musical instrument at the same time that he or she is playing the harmonica, may wish to use his or her hands for another purpose, or may not have the full use of his or her hands.

Heretofore, there has not been a satisfactory method of retaining more than one harmonica in place so as to permit the player to play multiple harmonicas without the use of his or her hands and switch between harmonicas. Harmonica holders are presently known, but all of these devices have deficiencies for the multiple harmonica player. One design in commercial production by M. Hohner of Germany supports a harmonica on the neck of the player, but permits only one harmonica to be held and played at a time, thereby substantially limiting the variety and quality of harmonica music capable of being generated. Another harmonica holder design, U.S. Pat. No. 4,713,999 to Burt, holds more than one harmonica, but requires the player to use his or her hands to switch between the harmonicas, thereby constraining the ability to switch harmonicas if the player prefers to use his or her hands for another purpose. Yet another harmonica holder design, U.S. Pat. No. 4,287,893 to Zema, also holds more than one harmonica, but the harmonicas are aligned parallel to a rotating axis so that the player must rotate the apparatus to switch between harmonicas. The Zema holder also permits only one harmonica to be played at a time and requires use of the player's hands.

It can be seen then, that an apparatus is needed which permits a harmonica player to play multiple harmonicas and switch between harmonicas without the use of his or her hands. Such an apparatus should be capable of holding different types and sizes of harmonicas at the same time at substantially the same distance from the player's lips so that hands-free playing is facilitated. The present invention addresses these as well as other problems associated with harmonica holders.

SUMMARY OF THE INVENTION

The present invention is directed to a harmonica support apparatus for supporting a harmonica from the neck and shoulders of a musician. The support apparatus includes a harmonica holder which may retain a plurality of harmonicas. The support apparatus is configured in one embodiment so that the harmonicas are arranged side by side, on top of one another, or in a combination thereof. In another embodiment, the holder may be configured with a central holder for retaining one harmonica before a player's mouth and lateral holders positioned on either side of the central holder. The holder may be varied so as to include perforations to facilitate the exit of sound and air. A textured grip may be added to the exterior surface of the holder to improve handling.

The harmonica holder is supported proximate to a player's mouth by a supporting apparatus. The supporting apparatus may be configured so the plurality of harmonicas is positioned for playing at any given time without the use of the player's hands. This harmonica support apparatus may be configured to include a portion extending around the back of the player's neck.

An alternate embodiment of the invention includes use of a detachable music holder for holding printed music in view of the player. An additional embodiment includes structure for mounting the support apparatus over the player's shoulders and generally following the contour of the player's shoulders from front to rear, and attaching at the waist of the player.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

BRIEF DESCRIPTION OF THE DRAWINGS

In the drawings, wherein like reference letters and numerals designate corresponding elements throughout the several views:

FIG. 6 shows a top elevational view of an alternate embodiment of the harmonica holder; and, FIG. 7 shows a side elevational view of an alternate embodiment of a harmonica support apparatus.

DETAILED DESCRIPTION OF THE PREFERRED EMBODIMENT(S)

Figure 1:
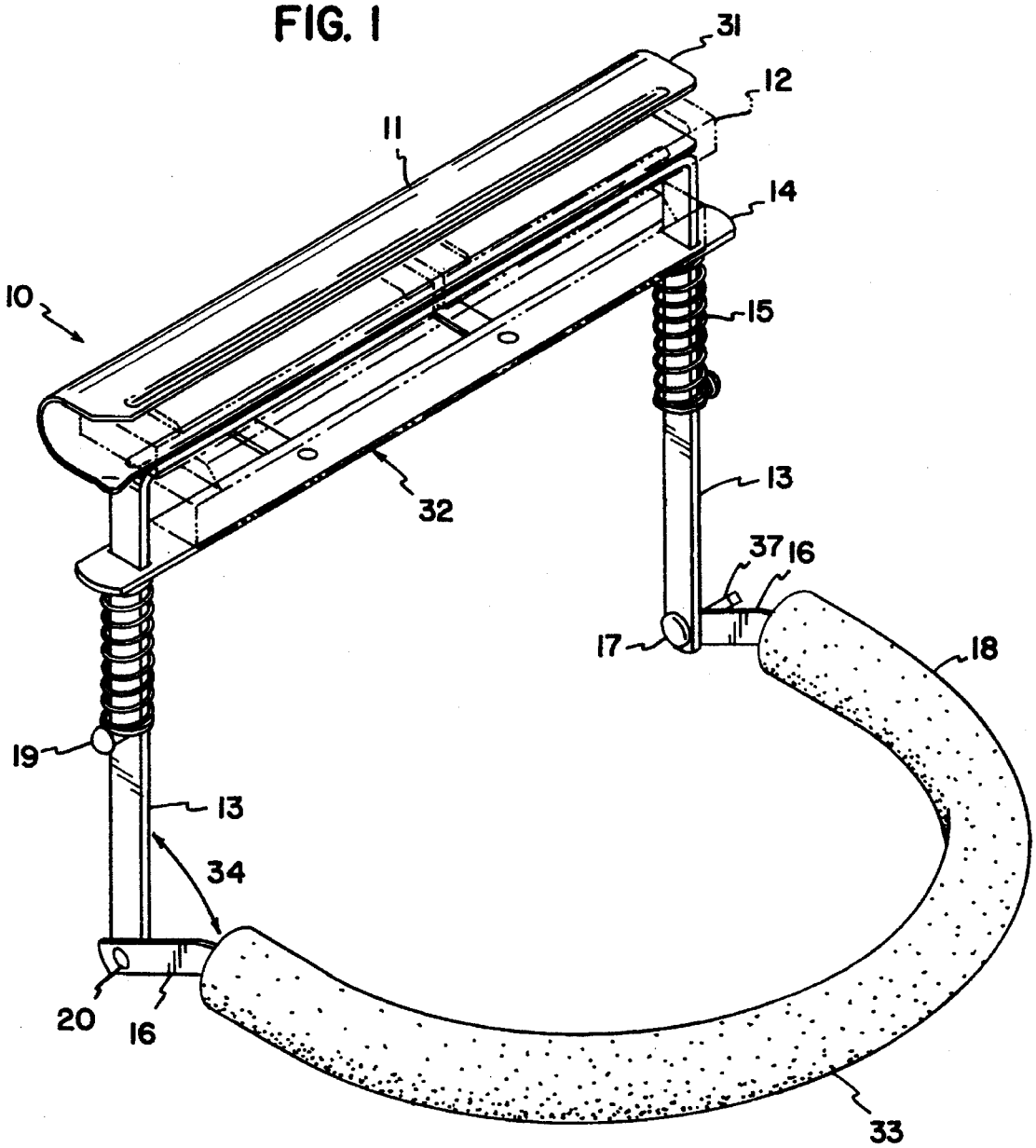
FIG. 1 shows a perspective view of a multiple harmonica support apparatus according to the principles of the present invention.

Referring now to the drawings, wherein like reference numerals designate corresponding structure throughout the views, and referring in particular to FIG. 1, there is shown a harmonica support apparatus, generally designated 10, for supporting a harmonica from the neck and shoulders of a musician. The harmonica support apparatus 10 has a harmonica holder 11 that retains a plurality of harmonicas 12. The harmonica holder 11 may be configured to hold harmonicas in a number of different manners. In a first embodiment, the harmonica holder 11 holds the harmonicas side-by-side and/or on top of one another. The upper portion 31 of the harmonica holder 11 holds a plurality of harmonicas 12 by a clasping or pinching action of the walls of the harmonica holder 11 or by clamp member 40, as detailed in FIG. 3. The clamp member 40 is slightly flexed outward when retaining the harmonicas 12 for applying a pinching or compressing force to the upper and lower surfaces of the harmonicas 12, thereby holding them in place.

Figure 2:
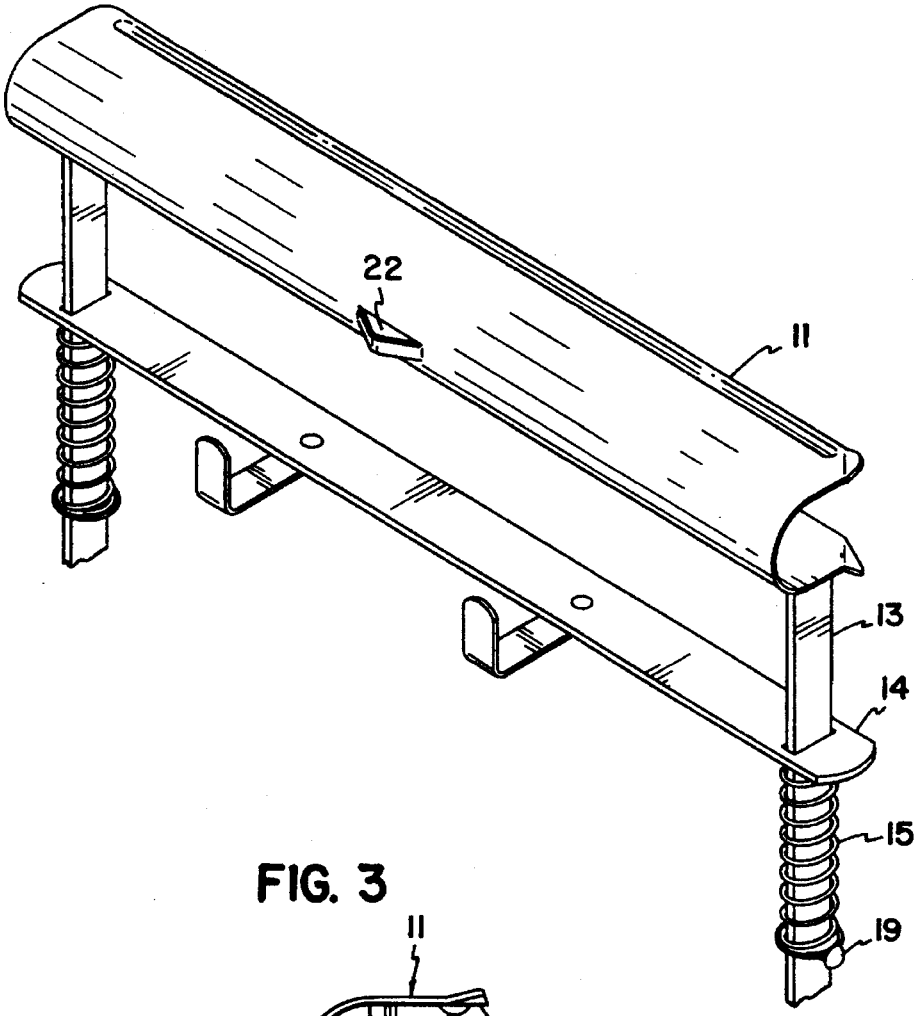
FIG. 2 Shows a perspective view of the harmonica holder for the support apparatus shown in FIG. 1.
Figure 3:
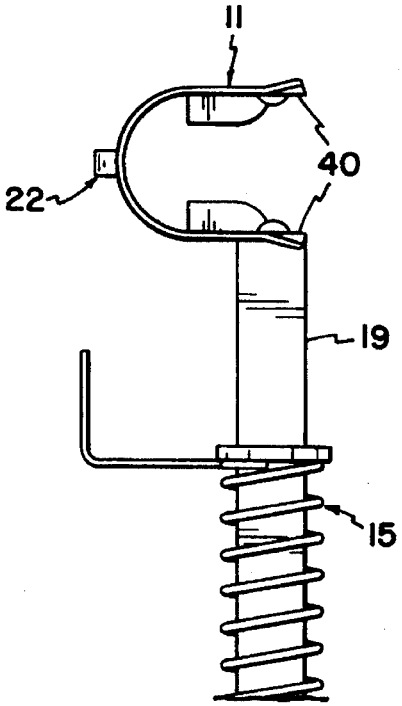
FIG. 3 shows a side elevational view of the harmonica holder shown in FIG. 2.

Furthermore, as shown in FIGS. 2 and 3, a lower portion 14 of the harmonica holder 11 holds one or more harmonicas. The lower portion 14 includes a cross member 32 slidably mounted on support apparatus arms 13. Two compression springs 15 are also mounted on the support apparatus arms 13 and are held in place by a retaining pin 19, also attached to the support apparatus arms 13. The compression springs 15 are mounted such that they exert an upward force on the cross member 32. A harmonica is held in place by the clasping force exerted between the cross member 32 and the upper portion of the harmonica holder The support apparatus arms 13 are further attached to a padded neck support 33. The padded neck support 33 includes a rigid frame 16 upon which is mounted a neck pad 18. The rigid frame 16 is connected to the support apparatus arms 13 at two pivot points 17 and 20. At least one of the pivot points 17 and 20 includes an apparatus 37 for adjusting the angle 34 between the support apparatus arms 13 and the rigid frame 16. The adjusting apparatus 37 may be a nut and bolt combination or similar apparatus for increasing or reducing stiffness at the joints 17 and 20.

Figure 4:
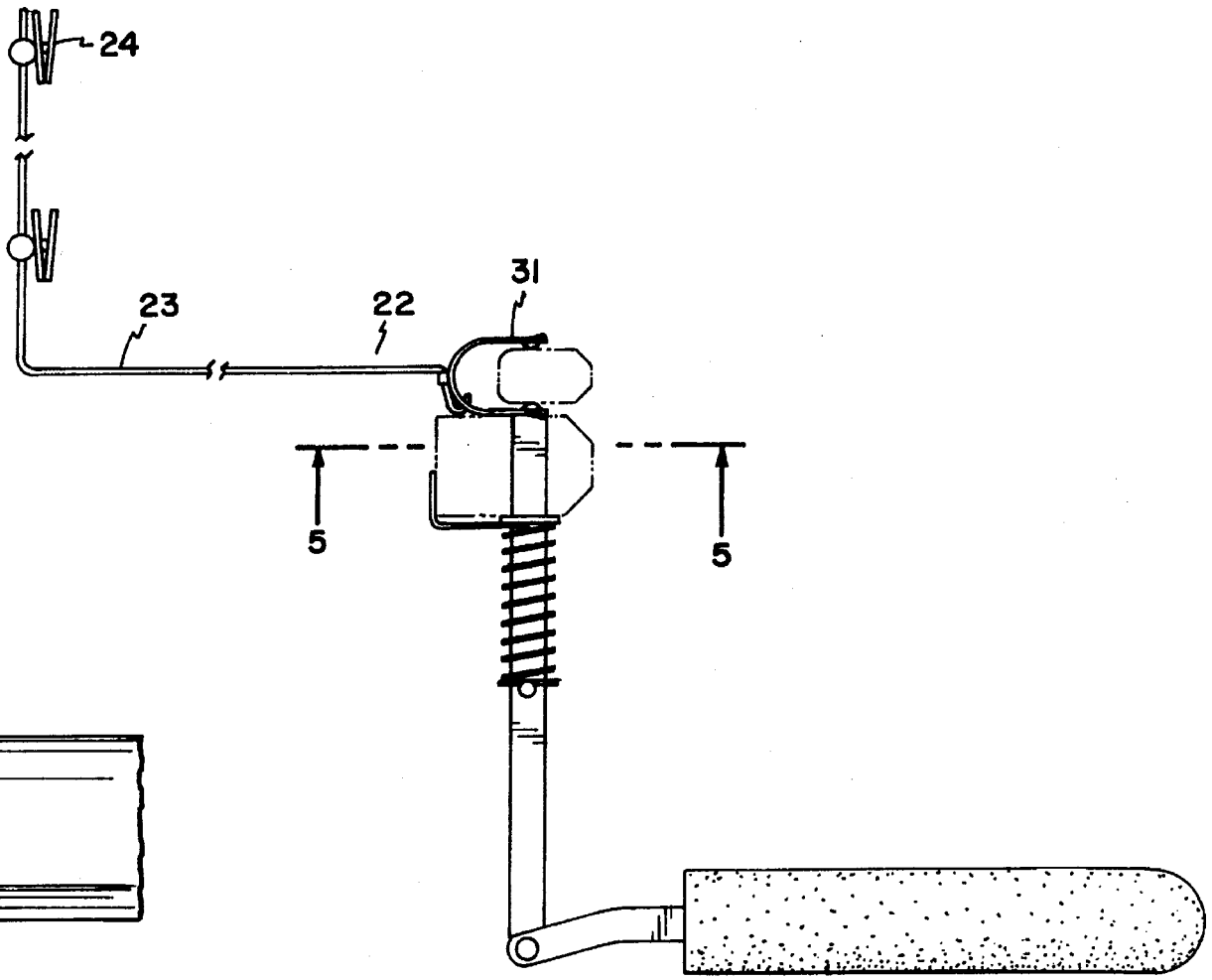
FIG. 4 shows a side elevational view of the harmonica support apparatus shown in FIG. 1, along with a detachable music holder.
Figure 5:
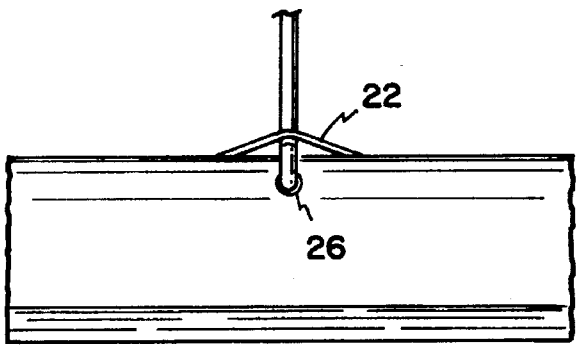
FIG. 5 shows a bottom plan view of the detachable music holder support.

Referring now to FIGS. 3, 4 and 5, the harmonica support apparatus 10 includes use of a detachable music holder 23 for holding printed music in view of the player. The detachable music holder 23 attaches to the harmonica holder 11 at a junction 22. The junction 22 includes an opening 26 into which an end hook member of the music holder 23 is securely fastened. The music holder 23 is constructed of a thin wire or rod constructed of metal, plastic, wood, or other rigid, yet flexible, material. The music holder 23 further includes clips 24 to which sheets of music may be attached. The clips 24 are slidable along the music holder 23 in order to adjust to the musician's preferences.

Referring now to FIG. 6, a second embodiment of the harmonica holder 11 is configured to include a central holder 28 and lateral holders 27 positioned on either side of the central holder. This configuration allows additional harmonicas to be held within convenient access of the musician's mouth. The lateral holders 27 are preferably configured to form an internal angle 38 with the central holder 28 of between 90° and 180°. The holders 27 and 28 hold harmonicas by a pinching or clasping action as discussed with regard to the harmonica holder 11.

As shown in FIGS. 6 and 7, the harmonica holder 11 may be varied so as to include perforations 25 to facilitate the exit of sound and air. The perforations may be of any shape and size which permits air and sound to exit the harmonica holder 11.

As shown in FIG. 7, an additional embodiment of the harmonica support apparatus 10 includes a support structure 35 for mounting the support apparatus over the player's shoulders. The support structure 35 provides the advantage of distributing weight more evenly and stably onto the musician's body. The support structure 35 mounts on the musician's shoulders by means of a support yolk 36. For additional support, an attachment strap 29 and clasp mechanism 30 attaches to the belt, pants, suspenders, or other clothing of the musician.

The embodiments described above permit the harmonica player to play multiple harmonicas and switch between the harmonicas without the use of his or her hands. Harmonicas of different types and sizes are held at the same time at substantially the same distance from the player's lips, permit the player to play without his or her hands, and change between harmonicas readily and easily. This improvement will permit harmonica players to play a greater variety of music with ease.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A harmonica support apparatus for supporting a harmonica on a player, comprising:

means for retaining a plurality of harmonicas; and means for supporting the retaining means proximate a player's mouth;

wherein the harmonica retaining means is selectively configured for retaining the harmonicas so that each of the plurality of harmonicas is accessible to the player's mouth for playing at any given time without the use of the player's hands.

2. The harmonica support apparatus of claim 1, wherein the supporting means comprises a portion configured for extending around the back of the player's neck.

3. The harmonica support apparatus of claim 1, wherein the retaining means comprises a retaining frame holding the harmonicas before the player's mouth.

4. The harmonica support apparatus of claim 1, wherein the retaining means comprises means for retaining at least a first one of the plurality of harmonicas at a first level and at least a second one of the plurality of harmonicas at a second different level.

5. The harmonica support apparatus of claim 1, wherein the harmonica retaining means is selectively configured for retaining the harmonicas at substantially the same distance from the player's mouth wherein each of the plurality of harmonicas may be played by the player turning or lowering or raising his/her head.

6. The harmonica support apparatus of claim 1, wherein the harmonica retaining means are selectively configured for retaining the harmonicas simultaneously at a distance accessible to the player's mouth.

7. The harmonica support apparatus of claim 1, further comprising a detachable music holder mounted to the retaining means and extending outward from the player, whereby the holder is configured for holding printed music in view of the player.

8. The harmonica support apparatus of claim 1, wherein the harmonica retaining means includes perforations formed therein so as to allow sound and air to exit the retaining means.

9. A harmonica support apparatus for supporting a plurality of harmonicas on a player, wherein each of the harmonicas has a front and rear portion having orifices formed therein, a top, a bottom, and opposite ends, said harmonica support apparatus comprising:

means for retaining the plurality of harmonicas; and means for supporting the retaining means proximate a player's mouth;

wherein the retaining means comprises central retaining means positioned for retaining a first harmonica of the plurality of harmonicas before a player's mouth so that the front of the harmonica faces the player's mouth and lateral retaining means positioned on either opposite end of the first harmonica for retaining at least a second harmonica of the plurality of harmonicas extending from either end of the first harmonica; and wherein the retaining means is selectively configured for retaining the plurality of harmonicas so that each of the plurality of harmonicas is accessible to the player's mouth for playing at any given time without the use of the player's hands.

10. The harmonica support apparatus of claim 9, wherein the lateral retaining means retains the additional harmonicas in a substantially horizontal plane at an internal angle between the lateral retaining means and central remaining means of more than 90° and less than 180°.

11. The harmonica support apparatus of claim 9, wherein the harmonica retaining means are selectively configured for retaining the harmonicas at substantially the same distance from the player's mouth whereby the harmonicas may be played as retained without moving the harmonicas.

12. The harmonica support apparatus of claim 9, wherein the harmonica retaining means are selectively configured for retaining the harmonicas simultaneously at substantially the same distance from the player's mouth.

13. The harmonica support apparatus of claim 9, wherein the supporting means comprises a portion extending around the back of the player's neck.

14. The harmonica support apparatus of claim 9, further comprising a detachable music holder removably mounted to the retaining means, configured for holding printed music in view of the player.

15. The harmonica support apparatus of claim 9, wherein the harmonica retaining means includes perforations formed therein so as to allow sound and air to exit the retaining means.

16. A harmonica support apparatus for supporting a plurality of harmonicas proximate a harmonica player's mouth, comprising:

means for mounting over the player's shoulders and generally following the contour of the player's shoulders from front to rear;

means attaching to clothing at the waist of the player and to the mounting means for retaining the mounting means in position; and harmonica support means extending from the mounting means for holding the plurality of harmonicas proximate to the player's mouth;

wherein the harmonica support means is selectively configured for retaining the harmonicas so that each of the plurality of harmonicas is accessible to the player's mouth for playing at any given time without the use of the player's hands.

17. The harmonica support apparatus of claim 16, further comprising a detachable music holder mounted to the harmonica's support means, configured for holding printed music in view of the player.

* * * * *